US008534478B2

(12) United States Patent
Mays, III et al.

(10) Patent No.: US 8,534,478 B2
(45) Date of Patent: Sep. 17, 2013

(54) COLLABSIBLE CONTAINER AND METHOD OF USING COLLAPSIBLE CONTAINERS

(75) Inventors: Charles Ishmael Mays, III, Frisco, TX (US); Gregory M. Hogle, Jackson, MI (US); Byron Lee Sharp, Whittier, CA (US); Donald Harold Ankney, Ellicott City, MD (US); Brady Glen Gutekunst, Anaheim, CA (US)

(73) Assignee: Dr Pepper/Seven Up, Inc., Plano, TX (US)

( * ) Notice: Subject to any disclaimer, the term of this patent is extended or adjusted under 35 U.S.C. 154(b) by 107 days.

(21) Appl. No.: 13/028,771

(22) Filed: Feb. 16, 2011

(65) Prior Publication Data

US 2012/0037661 A1 Feb. 16, 2012

Related U.S. Application Data

(60) Provisional application No. 61/306,279, filed on Feb. 19, 2010.

(51) Int. Cl.
*B65D 90/02* (2006.01)

(52) U.S. Cl.
USPC ..... 215/381; 215/900; 215/382; 220/6; 220/666; 222/143; 222/215

(58) Field of Classification Search
USPC ..... 222/143, 215, 107; 215/900, 381, 215/382; 220/6, 666
See application file for complete search history.

(56) References Cited

U.S. PATENT DOCUMENTS

| | | | | | |
|---|---|---|---|---|---|
| 3,727,803 | A * | 4/1973 | Cobb | 222/215 |
| 3,921,897 | A | 11/1975 | Noyes et al. | |
| 3,939,888 | A * | 2/1976 | Scarnato | 220/666 |
| 4,397,393 | A | 8/1983 | Pergande et al. | |
| 4,790,361 | A | 12/1988 | Jones et al. | |
| 4,930,644 | A * | 6/1990 | Robbins, III | 215/382 |
| 5,174,458 | A | 12/1992 | Segati | |
| 5,226,551 | A * | 7/1993 | Robbins, III | 220/8 |
| 6,095,360 | A * | 8/2000 | Shmagin et al. | 215/382 |
| 6,158,620 | A | 12/2000 | Polan | |
| 7,059,487 | B2 * | 6/2006 | Ohlsson | 215/381 |
| 2003/0173327 | A1 | 9/2003 | Melrose | |
| 2005/0242204 | A1 * | 11/2005 | Ness et al. | 239/24 |
| 2008/0003387 | A1 * | 1/2008 | Altonen et al. | 428/35.2 |

* cited by examiner

*Primary Examiner* — Kevin P Shaver
*Assistant Examiner* — Michael J Melaragno
(74) *Attorney, Agent, or Firm* — Michael Woods

(57) ABSTRACT

A collapsible container and a method of using the collapsible container are provided. In one embodiment of the container, the container comprises a collapsible fold area associating a base portion with a nestable portion, the collapsible fold area being structured such that a collapsing of collapsible fold area results in disposal of at least a portion of the nestable portion within the base volume. In one embodiment of the method, the method comprises the steps of nestling the collapsed containers with one another for efficient space storage when said collapsed containers are not in use, and releasing a vacuum or applying a force to return a collapsed container to its full or expanded position.

7 Claims, 8 Drawing Sheets

COLLABSIBLE CONTAINER AND METHOD OF USING COLLAPSIBLE CONTAINERS

CROSS REFERENCE TO RELATED APPLICATIONS

This application claims priority to U.S. Provisional Patent Application No. 61/306,279, filed on Feb. 19, 2010, the contents of which are hereby incorporated by reference.

FIELD

The disclosure relates generally to a collapsible container, and more specifically to a beverage container, and a method for using such collapsible containers for dispensing beverages.

BACKGROUND

Containers used for storing various solid and liquid goods are well known. Containers used in fast food and convenience stores for holding beverages are also well known.

For some time restaurants and convenience stores have offered relatively large containers that may be filled on premise and removed for holding a liquid or solid, such as a beverage for consumption. While the relatively large size of these containers allows a customer to transport large quantities of their favorite beverage, containers of this size also present the restaurant and convenience store owner with inventory issues in that such containers can be cumbersome and difficult to store.

Accordingly, demand exists for a beverage container that can both contain a relatively large quantity of fluid, and be more efficiently stored.

SUMMARY

According a first preferred embodiment, a method for dispensing beverages is provided. The method comprises the steps of: providing a plurality of collapsed containers, wherein a vacuum in each of said plurality of containers causes said containers to collapse; nestling the collapsed containers with one another for efficient space storage when said collapsed containers are not in use; opening at least one of said collapsed containers, thereby releasing the vacuum and expanding the container to its full position; filling the expanded container with a beverage; and closing the container with a closure cap.

In some, but not all, embodiments of the method of the first preferred embodiment, the step of opening at least one of said collapsed containers comprises the step of removing the closure cap.

In yet some other, but not all, embodiments of the method of the first preferred embodiment, the nestled collapsed containers are stacked vertically with one another.

In yet some other, but not all, embodiments of the method of the first preferred embodiment, the containers are manufactured from shape memory material.

In yet some other, but not all, embodiments of the method of the first preferred embodiment, the containers are configured to retain a pressure that is at least two times atmospheric pressure.

In yet some other, but not all, embodiments of the method of the first preferred embodiment, the containers are manufactured from a translucent material.

In yet some other, but not all, embodiments of the method of the first preferred embodiment, the containers have collapsible sidewalls.

In yet some other, but not all, embodiments of the method of the first preferred embodiment, the containers collapse vertically.

In yet some other, but not all, embodiments of the method of the first preferred embodiment, the closure cap is a threaded closure cap.

In yet some other, but not all, embodiments of the method of the first preferred embodiment, the beverage container is configured to hold about 72 oz of liquid.

In yet some other, but not all, embodiments of the method of the first preferred embodiment, the collapsed container occupies a volume of about 33% of the fully-expanded container.

In a second preferred embodiment of the disclosure, a method for dispensing beverages is provided. This method comprises the steps of: providing a plurality of containers, wherein the containers have a collapsed position and an expanded position; nestling at least two collapsed containers with one another for efficient space storage when said collapsed containers are not in use; applying a force to a collapsed container to expand the collapsed container to its expanded position; filling the expanded container with a beverage; and closing the container with a closure cap.

In yet some other, but not all, embodiments of the method of the second preferred embodiment, the nestled collapsed containers are stacked vertically with one another.

In yet some other, but not all, embodiments of the method of the second preferred embodiment, the containers are manufactured from shape memory material.

In yet some other, but not all, embodiments of the method of the second preferred embodiment, the containers are configured to retain a pressure that is at least two times atmospheric pressure.

In yet some other, but not all, embodiments of the method of the second preferred embodiment, the containers are manufactured from a translucent material.

In yet some other, but not all, embodiments of the method of the second preferred embodiment, the containers have collapsible sidewalls.

In yet some other, but not all, embodiments of the method of the second preferred embodiment, the containers collapse vertically.

In yet some other, but not all, embodiments of the method of the second preferred embodiment, the closure cap is a threaded closure cap.

In yet some other, but not all, embodiments of the method of the second preferred embodiment, the beverage container is configured to hold about 72 oz of liquid.

In yet some other, but not all, embodiments of the method of the second preferred embodiment, the collapsed container occupies a volume of about 33% of the fully-expanded container.

In a third preferred embodiment of the disclosure, a collapsible container is provided. The collapsible container comprises: a base portion delimiting a base volume; a nestable portion configured and sized for nestability within the base volume; and a collapsible fold area associating the base portion with the nestable portion, the collapsible fold area being structured such that a collapsing of collapsible fold area results in disposal of at least a portion of the nestable portion within the base volume.

In yet some other, but not all, embodiments of the container of the third preferred embodiment, a material comprising the base portion and a material comprising the nestable portion are more densely constructed than a material comprising the collapsible fold portion.

In yet some other, but not all, embodiments of the container of the third preferred embodiment, a material comprising the base portion and a material comprising the nestable portion are thicker than a material comprising the collapsible fold portion.

In yet some other, but not all, embodiments of the container of the third preferred embodiment, a material comprising the collapsible fold portion is a plastic, the collapsing of the collapsible fold area occurring at a cooling stage of the plastic.

In yet some other, but not all, embodiments of the container of the third preferred embodiment, a material comprising the collapsible fold portion is a plastic, said plastic having been extruded and molded, and the collapsing of the collapsible fold area occurs prior to the hardening of the plastic and instead occurs during the cooling stage of the plastic.

In yet some other, but not all, embodiments of the container of the third preferred embodiment, the container is a beverage container.

In a fourth preferred embodiment of the invention, a collapsible container is provided. The collapsible container comprises: a container body delimiting a fluid volume configured for holding a fluid, the container body including a container opening and a container base; and a collapsing zone defined by the container body and configured to allow a relatively horizontal collapsing of at least a portion of the container.

In yet some other, but not all, embodiments of the container of the fourth preferred embodiment, the collapsing zone includes a base segment traversing a lateral extent of the base portion, and two vertical segments extending to a vertical extent of the container body, the vertical segments being associated via the base segment and disposed at relatively opposing sides of the container body.

In yet some other, but not all, embodiments of the container of the fourth preferred embodiment, the vertical segments terminate at or in proximity to a neck portion defined by the container body, the neck portion defining the container opening.

In yet some other, but not all, embodiments of the container of the fourth preferred embodiment, the collapsing zone is a groove extending into the fluid volume and including relatively opposing groove walls, the groove being collapsible via movement of at least one of the opposing groove walls towards the other of the opposing groove walls.

In yet some other, but not all, embodiments of the container of the fourth preferred embodiment, the container is a beverage container.

In a fifth embodiment of the disclosure, a collapsible container is provided. The container comprises: a bottom portion, said bottom portion having a height that is about ⅓ the total height of the container and wherein said bottom portion has a first diameter; a top portion, said top portion having a second diameter, wherein said second diameter is less than said first diameter; an intermediate portion, said intermediate portion connecting the bottom portion with top portion; a first reinforcing ridge, said first reinforcing ridge connecting the bottom portion with the intermediate portion, and said first reinforcing ridge having a material strength that is greater than the intermediate portion and greater than the bottom portion; and a second reinforcing ridge, said second reinforcing ridge connecting the top portion with the intermediate portion, and said second reinforcing ridge having a material strength that is greater than the intermediate portion and the top portion; wherein the intermediate portion is more pliable than the top portion, wherein the intermediate portion is more pliable than the bottom portion, and wherein a vacuum applied to the container causes the top portion to collapse within the bottom portion.

In yet some other, but not all, embodiments of the container of the fifth preferred embodiment, the top portion and the bottom portion comprise rib structures, said rib structures configured to provide structural rigidity to the top portion and the bottom portion, and further wherein the intermediate portion is void of any rib structures. In yet some other, but not all, embodiments of the container of the fifth preferred embodiment, the ribs are vertical rib structures that are spaced equally apart from one another around the circumference of the container.

In yet some other, but not all, embodiments of the container of the fifth preferred embodiment, the top portion comprises a threaded opening, said threaded opening configured to engage with a threaded cap, wherein when said cap is engaged with the opening, an air-tight seal is created within the container.

In yet some other, but not all, embodiments of the container of the fifth preferred embodiment, the top portion comprises a handle.

In yet some other, but not all, embodiments of the container of the fifth preferred embodiment, the container is cylindrical about its vertical axis.

In yet some other, but not all, embodiments of the container of the fifth preferred embodiment, the container is manufactured from a unitary piece of polyethylene.

In yet some other, but not all, embodiments of the container of the fifth preferred embodiment, the container is collapsed, the collapsed container is configured to nest with other similar collapsed containers.

In a sixth preferred embodiment of the disclosure, a collapsible container is provided. The container comprises: a cylindrical body about its vertical axis with a round base portion; a collapsible zone, said collapsible zone runs along the base portion and along opposite sides of the cylindrical body; wherein said collapsible zone comprises at least two opposing walls, said two opposing walls being configured to collapse towards one another when a vacuum is applied to the container, causing said container to collapse.

In yet some other, but not all, embodiments of the container of the sixth preferred embodiment, a top of the container comprises a threaded opening, said threaded opening configured to engage with a threaded cap, wherein when said cap is engaged with the opening, an air-tight seal is created within the container.

In yet some other, but not all, embodiments of the container of the sixth preferred embodiment, a top of the container comprises a handle.

In yet some other, but not all, embodiments of the container of the sixth preferred embodiment, the container is manufactured from a unitary piece of polyethylene.

In a seventh preferred embodiment, a collapsible container is provided. The collapsible container comprises: a top portion, said top portion being about ½ the total height of the container; a bottom portion, said bottom portion being about ½ the total height of the container; handles integrally formed on the top portion; a threaded opening integrally formed on the top of the top portion; and a junction between the top portion and the bottom portion, said junction comprised of material that is more pliable than the top portion; wherein the junction is more pliable that the bottom portion, and wherein when a vacuum is applied to the container, the top portion collapses within the bottom portion and the junction deforms by about 180 degrees as measured from vertical.

The reader should appreciate that any of the steps of preferred embodiment one may also be incorporated into steps of preferred embodiment two, and vice versa. Further, the reader should appreciate that any of the particular embodiments of any of the containers disclosed in embodiments three through seven may be used in any of the other preferred embodiments three through seven.

BRIEF DESCRIPTION OF THE FIGURES

Referring now to the Figures, exemplary embodiments are illustrated, wherein the elements are numbered alike.

DETAILED DESCRIPTION

Figure 2:
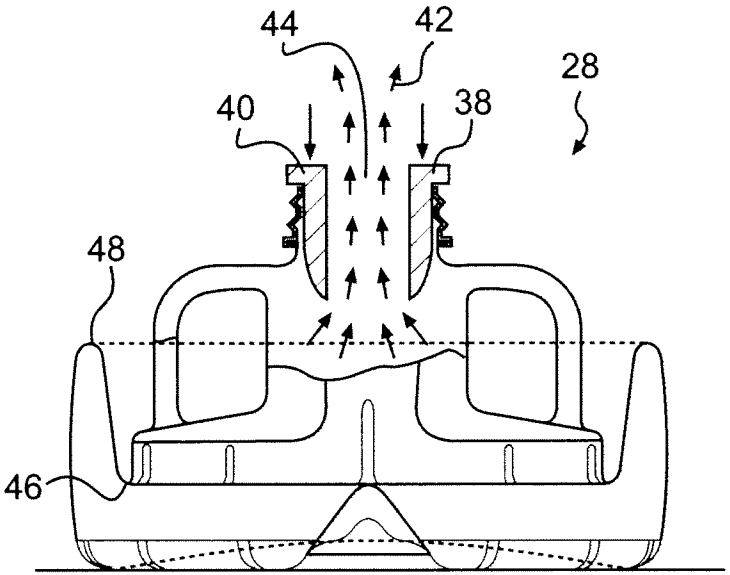
FIG. 2 is another elevation view of the collapsible container in accordance with the first exemplary embodiment.

Referring first to FIGS. 1-10, an exemplary embodiment of a collapsible container 10 is illustrated. In this particular embodiment, container 10 is cylindrical about its vertical axis. The container 10 includes a container body 11 delimiting a volume configured for holding a fluid or solid, a nestable portion 12, a fold area 14, and base portion 16. The nestable portion 12, which includes a container opening 18 and container handles 20, extends essentially from the fold area 14 to an upper extent of the container 10. As shown in the Figures, the fold area 14 connects the nestable portion 12 with the base portion 16. As will be explained in greater detail below, the base portion 16 and nestable portion 12 are less susceptible to collapsing than fold area 14.

With reference to the differing material construction in the varying portions of the container 10, it should be noted that there are various options for constructing the material in the fold area 14 such that it is collapsible relative to the nestable portion 12 with the base portion 16. In one embodiment, an extruded plastic (such as high density (hard) Polyethylene, low density (soft) Polyethylene, or a blend thereof) from which the entire container 10 is constructed is less densely constructed in the fold area 14 than the nestable portion 12 and base portion 16. This may be achieved via permeation of air into the fold area 14 during extrusion of the plastic, which in turn creates a more porous and less dense region, and enhances pliability of the area 14 relative to the nestable portion 12 and base portion 16.

In addition to or instead of being less densely constructed, the fold area 14 may also be extruded and molded to include a lesser thickness than the nestable portion 12 and base portion 16. Such a relative thinness in the container wall forming the fold area 14 also serves to enhance pliability of the area 14 relative to the nestable portion 12 and base portion 16. Of course, the nestable portion 12 and base portion 16 may be further extruded and molded to include support structure that hardens the nestable portion 12 and base portion 16 relative to the fold area 14. Such support structure may include the rib structures 22 shown at the nestable portion 12 and base portion 16 in the Figures, hardening features inherently created via the design and shape of the handles 20 and threaded opening 18, and/or a reinforcing ridge 25 disposed at a junction between the base portion 16 and fold area 14 (please see FIG. 11). As can be seen in the particular embodiment of FIGS. 1-10, rib structures 22 are spaced equally apart from one another around the circumference of container 10.

Figure 7:
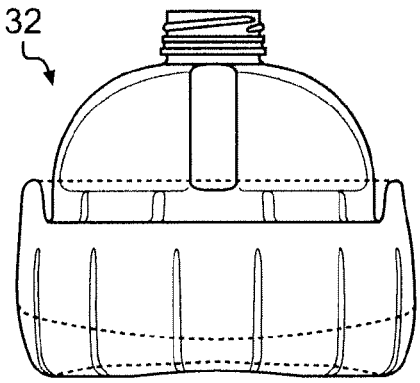
FIG. 7 is another elevation view of the collapsible container in accordance with the first exemplary embodiment.
Figure 8:
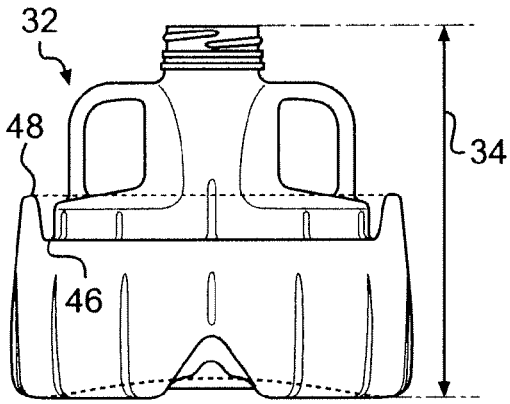
FIG. 8 is another elevation view of the collapsible container in accordance with the first exemplary embodiment.
Figure 9:
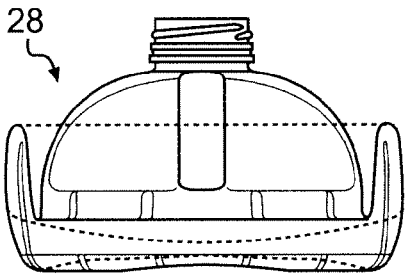
FIG. 9 is another elevation view of the collapsible container in accordance with the first exemplary embodiment.
Figure 10:
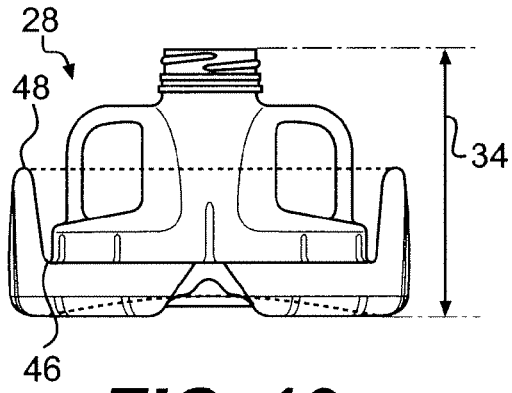
FIG. 10 is another elevation view of the collapsible container in accordance with the first exemplary embodiment.
Figure 12:
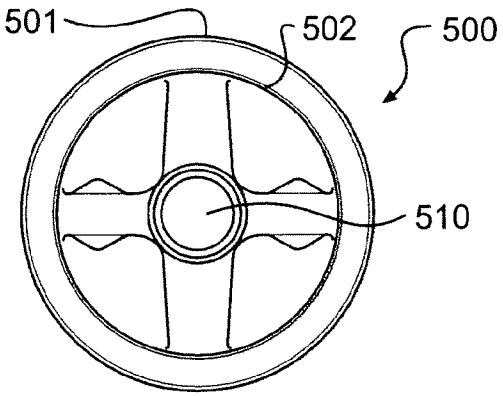
FIG. 12 is an elevation view of the collapsible container from a top perspective in accordance with another exemplary embodiment.
Figure 14:
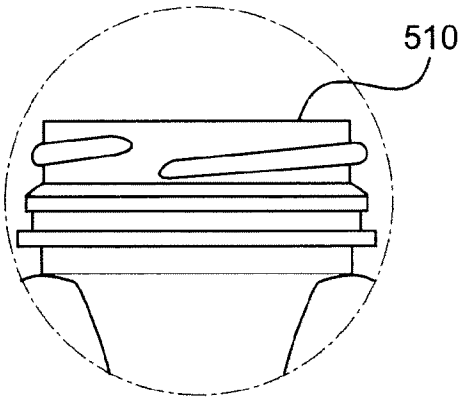
FIG. 14 is a partial elevation view of the collapsible container in accordance with another exemplary embodiment.

In light of the above discussed pliability of the fold area 14 relative to the nestable portion 12 and base portion 16, the container 10 may be vertically collapsed such that nestable portion 12 is pushed down into a volume 24 delimited by the base portion 16. This collapsing is best shown in FIGS. 1-10, wherein FIGS. 1, 3, and 4 show the container 10 in a non-collapsed configuration 26, FIGS. 2, 9, and 10 show the container 10 in a collapsed configuration 28, and FIGS. 5-8 show the container 10 in intermediate configurations 30 and 32 therebetween.

Figure 1:
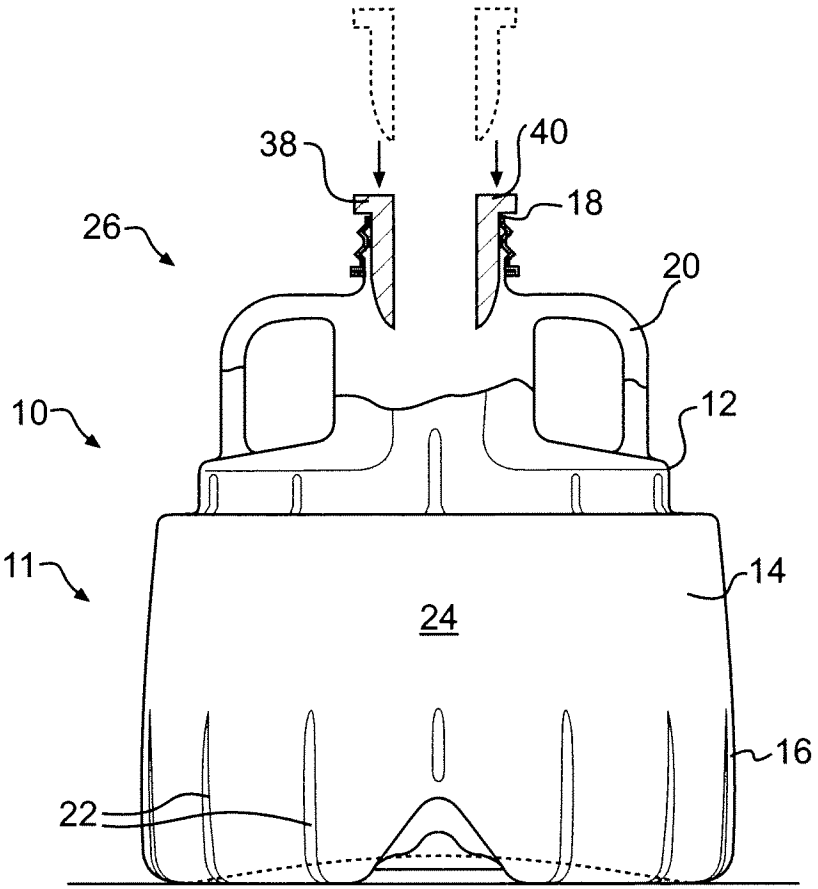
FIG. 1 is an elevation view of a collapsible container in accordance with a first exemplary embodiment.
Figure 3:
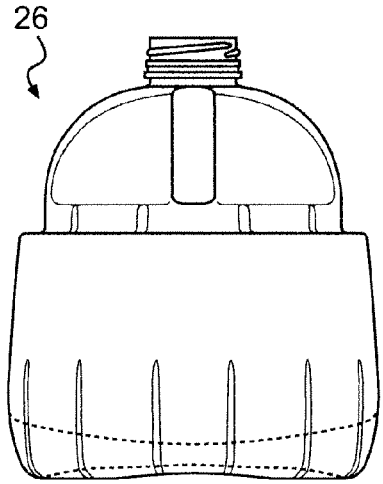
FIG. 3 is another elevation view of the collapsible container in accordance with the first exemplary embodiment.
Figure 4:
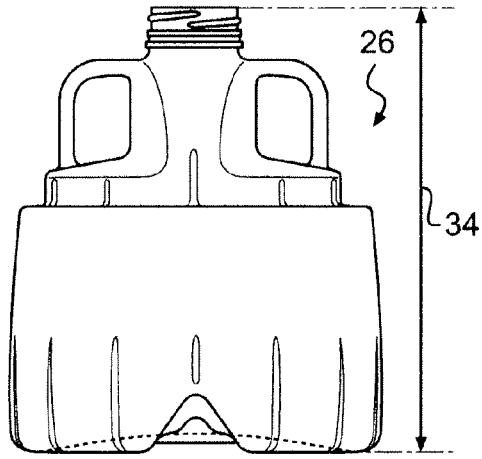
FIG. 4 is another elevation view of the collapsible container in accordance with the first exemplary embodiment.
Figure 5:
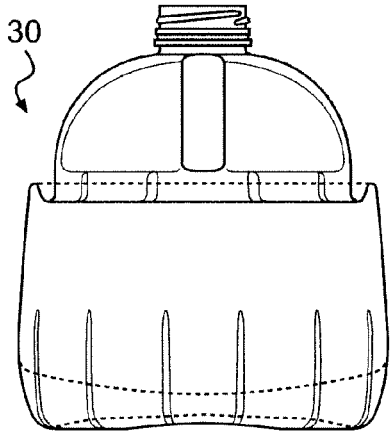
FIG. 5 is another elevation view of the collapsible container in accordance with the first exemplary embodiment.
Figure 6:
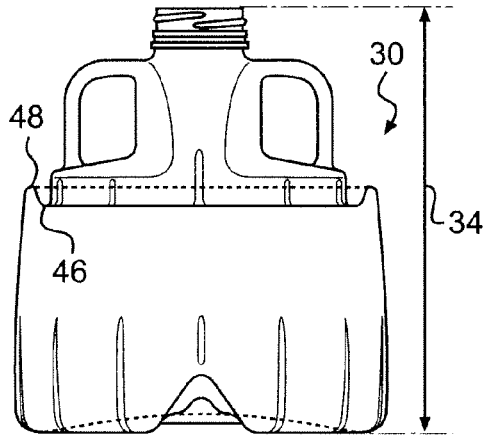
FIG. 6 is another elevation view of the collapsible container in accordance with the first exemplary embodiment.

In an exemplary embodiment of container 10, container 10 is sized to hold 72 oz and in the non-compressed configuration 26 includes a container height 34 of 7.625 inches (please see FIGS. 1, 3, and 4 in particular). In FIGS. 5 and 6, the container 10 is shown to be desirably configured such that the nestable portion 12 is collapsed into the base volume 24 in a manner that reduces the container height 34 by 0.25 inches (down to 7.375 inches). Referring to FIGS. 7 and 8, the container 10 is shown to be desirably configured such that the nestable portion 12 is collapsed into the base volume 24 in a manner that reduces the container height 34 by 1.5 inches (down to 6.125 inches). Lastly, referring to the fully collapsed container of FIGS. 2, 9, and 10, the container 10 is shown to be desirably configured such that the nestable portion 12 is collapsed into the base volume 24 in a manner that reduces the container height 34 by 3.3 inches (down to 4.326 inches).

This collapsing of the container 10 shown in configurations 28, 30, and 32 of FIGS. 2 and 5-10 serves to reduce potential shipping and storage volume occupied by the container 10. For example, a container collapsed to a desirable level of configuration 28 (please see FIGS. 2, 9, and 10) shows a reduction of the container height 34 by 43 percent. Of course, any compression between configurations 26 and 28, and any compression to an extent beyond configuration 28 that is structurally allowable by the respective configurations of the nestable portion 12 and base portion 16 of the nestable portion 24, may be desirable for shipping and/or storage.

Referring back to the above discussed pliability of the fold area 14, it should be noted that this area is most pliable/collapsible when the extruded plastic comprising this area is at a cooling stage. In other words, the container 10 in general is best suited for collapsibility after the plastic comprising the container 10 has been extruded and molded, but before the plastic is fully set/hardened (i.e., cooling prior to setting/hardening to a point of commercial viability).

The above discussed collapsing of the container 10 may be achieved in via various processes, including but not limited to that which is discussed below. In one exemplary embodiment, a vacuum device (not illustrated) may be attached to the opening 18 of a non-collapsed container 10. Suction created by such a device provides actuation that forces the nestable portion 12 down into the base volume 24 (or the base portion 16 up around the nestable portion 12). The container 10 may then be sealed via a seal or twist of cap 36 such as that shown in FIGS. 15-18. Sealing in this manner holds the collapsed container at the level to which the container has been collapsed. The container 10 may be vacuumed and sealed for shipping and storage at any desirably collapsed level between configurations 26 and 28 (or structural allowable configurations beyond configuration 28). When the container 10 is needed for use, the cap 36 may be removed. The container 10, which may be constructed of plastic that includes material memory characteristics, will then expand to non-collapsed configuration 26 shown in FIGS. 1, 3, and 4.

In another exemplary embodiment, a downward force applied at the opening 18 of the container 10 provides actuation that forces the nestable portion 12 down into the base volume 24. As shown in FIGS. 1 and 2, a neck fitment 38 that is inserted into the opening 18 may facilitate this actuation. This fitment 38 includes a lip 40 that is configured to receive a downward force (from, for example, an automated piston element) sufficient enough to force the nestable portion 12 down into the base volume 24. Internal gas 42 disposed within a volume of the container 10 is forced out of the container 10 through a fitment channel 44 defined by the fitment 38 during the collapsing of the container 10. Of course, without disposal of the fitment 38 in the opening 18, this gas 42 would simply escape through the opening 18. As discussed above, and due to vacuum conditions now present in the container 10, the container 10 may then be sealed via the seal or twist of cap 36 such as that shown in FIGS. 15-18. Again, the container 10 may be compressed and sealed for shipping and storage at any desirably collapsed level between configurations 26 and 28 (or structural allowable configurations beyond configuration 28). When the container 10 is needed for use, the cap 36 may be removed. The container 10, which may be constructed of plastic that includes material memory characteristics, will then expand to non-collapsed configuration 26 shown in FIGS. 1, 3, and 4.

Referring more specifically to a "folding" of the fold area 14, it should be noted that the container 10 collapses via two folds 46 and 48 occurring at fold area 14. As can be seen in FIGS. 8 and 10, folds 46 and 48 deform foldable area 14 slightly less than 180 degrees. In other words, each fold 46 and 48 are configured to deform and fold at about 180 degrees (or deform to form a U-shape), thereby permitting the container to collapse as shown in FIG. 10. Referring for example to FIGS. 2 and 5-10, collapsing of the nestable portion 12 into the base volume 24 (via vacuum, applied force, or otherwise) creates fold 46 at a junction between the nestable portion 12 and the fold area 14, and fold 48 at a junction between the base portion 16 and the fold area 14. As may be best demonstrated via what amounts to a collapsing progression from FIGS. 5-10, the fold area 14 rolls upon itself as the folds 46 and 48 move farther apart and the nestable portion 12 is nested/collapsed deeper into the base volume 24.

Referring now to FIGS. 11-14, another embodiment of the disclosure is shown. In this embodiment, container 500 has a bottom portion 501, a top portion 502, an intermediate portion 503, and handles 505. The reader should appreciate that portions 501, 503, and 502 may be similar to portions 16, 14, and 12, respectively, of FIGS. 1-10. For example, intermediate portion 503 may be made of a more pliable material than that of bottom portion 501 and top portion 502. Applying a downward force on top portion 502 or creating a vacuum within container 500 may cause container 500 to collapse, such that top portion 502 is within bottom portion 501. In this embodiment, the diameter of the top portion 502 is different from the diameter of bottom portion 501, so that top portion 502 can fit within bottom portion 501 when container 500 is in the collapsed position. As intermediate portion 503 joins bottom portion 501 with top portion 502, intermediate portion is disposed at an angle as measured from vertical.

The particular embodiment of FIGS. 11-14 also show reinforcing ridges 25 at the junction between bottom portion 501 and intermediate portion 503 and at the junction between top portion 502 and intermediate portion 503. In one exemplary embodiment, reinforcing ridge 25 comprises increased material thickness. In another exemplary embodiment, reinforcing ridge 25 comprises material with improved strength, which is less susceptible to failure when deformed. When container 500 transitions from its full position to its collapsed position, the majority of stress and deformation may occur at these junctions. As a result, adding reinforcing ridges 25 at these junctions may be desirable.

Figure 11:
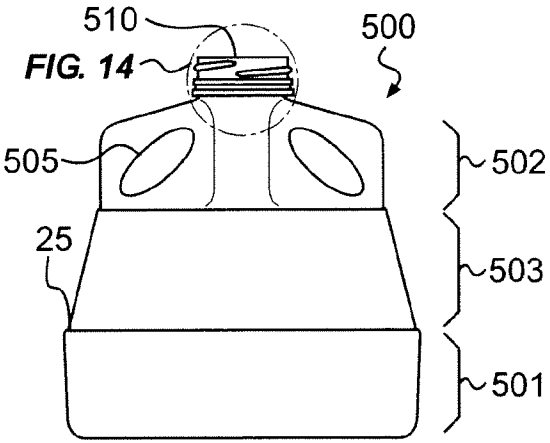
FIG. 11 is another elevation view of the collapsible container in accordance with the another exemplary embodiment.
Figure 13:
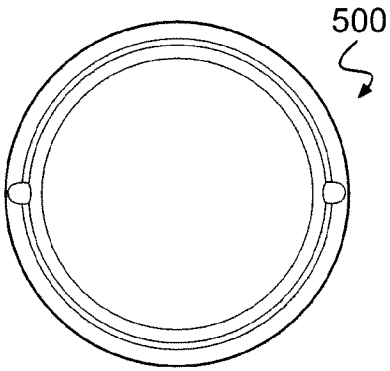
FIG. 13 is an elevation view of the collapsible container from a bottom perspective in accordance with another exemplary embodiment.
Figure 16:
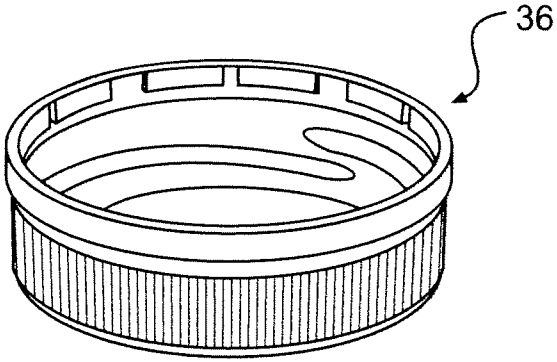
FIG. 16 is another perspective view of a cap for use with a collapsible container.
Figure 18:
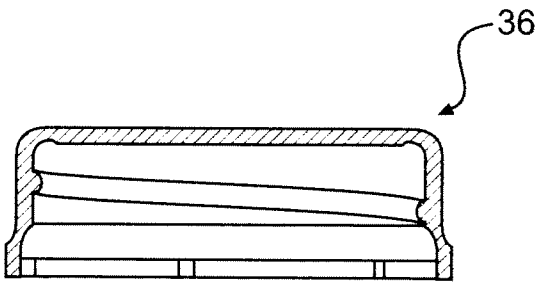
FIG. 18 is a cross-sectional elevation view of a cap for use with a collapsible container.
Figure 15:
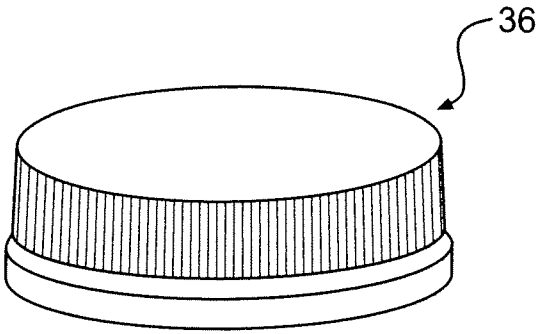
FIG. 15 is a perspective view of a cap for use with a collapsible container.
Figure 17:
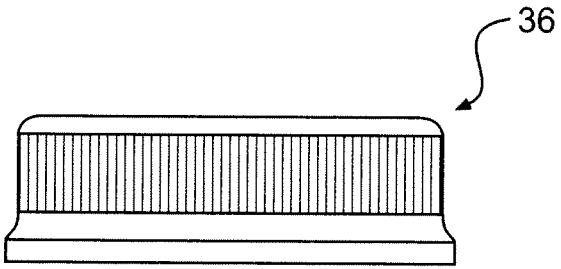
FIG. 17 is an elevation view of a cap for use with a collapsible container.
Figure 20:
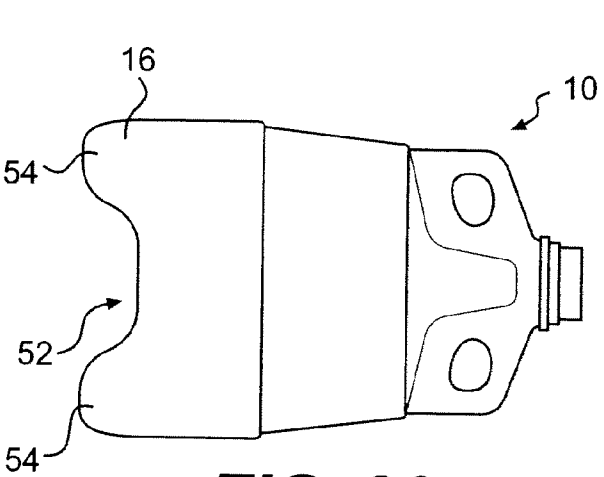
FIG. 20 is another elevation view of the collapsible container in accordance with an exemplary embodiment.
Figure 22:
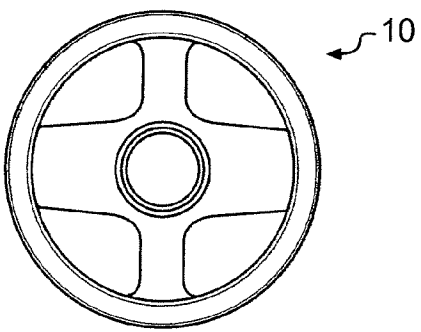
FIG. 22 is an elevation view of the collapsible container from a top perspective in accordance with an exemplary embodiment.

As can also be seen in FIGS. 11-14, the height of bottom portion 501, intermediate portion 503, and top portion 502 may each be about ⅓ of the total height of container 500. When a downward force is applied to container 500, as seen from FIG. 11, or when a vacuum is applied to container 500, container 500 collapses such that top portion 502 is within bottom portion 501, as the pliable material of intermediate portion 503 deforms to allow the transition from full position, as shown in FIG. 11, to collapsed position (not shown).

Container 500 may also have threaded opening 510, which is configured to engage a threaded cap 36, such as the one disclosed in FIGS. 15-18. In an exemplary embodiment, when cap 36 is engaged with opening 510, container 500 is capable of retaining a slight vacuum relative to atmospheric pressure and capable of retaining a carbonated beverage at a pressure greater than two times atmospheric pressure.

Figure 19:
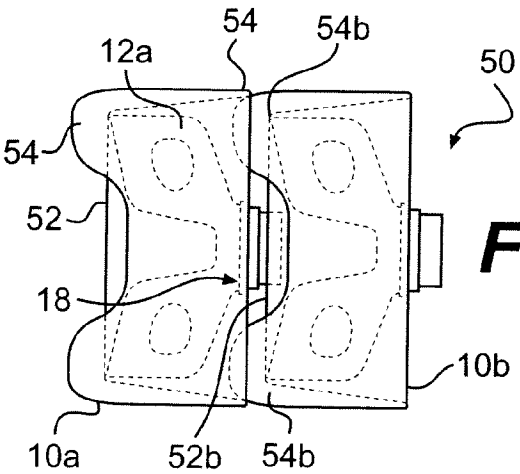
FIG. 19 is an elevation view of the collapsible container in accordance with the first exemplary embodiment as shown in stacked association with another collapsible container in accordance with an exemplary embodiment.
Figure 21:
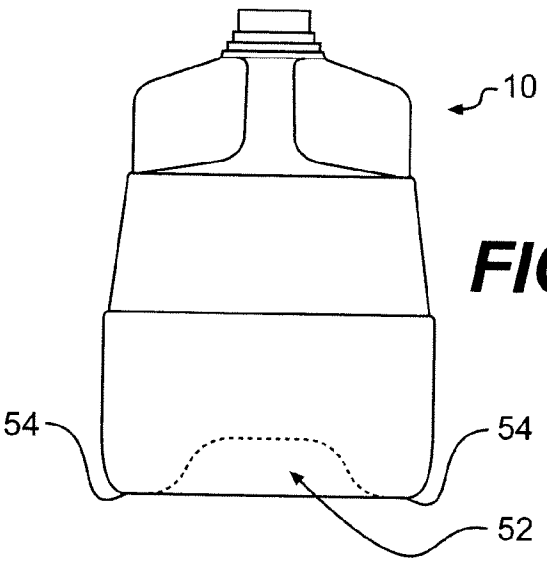
FIG. 21 is another elevation view of the collapsible container in accordance with an exemplary embodiment.
Figure 24:
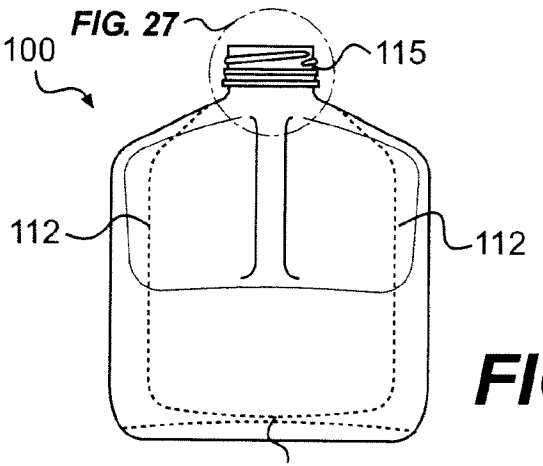
FIG. 24 is another elevation view of the collapsible container in accordance with another exemplary embodiment.
Figure 27:
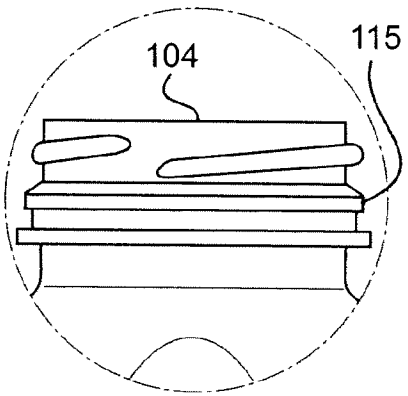
FIG. 27 is a partial elevation view of the collapsible container in accordance with another exemplary embodiment.
Figure 26:
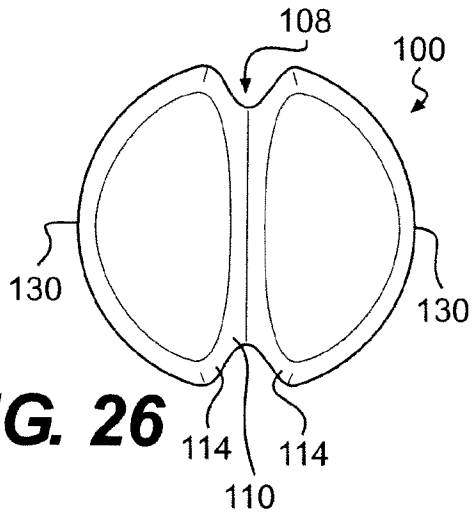
FIG. 26 is an elevation view of the collapsible container from a bottom perspective in accordance with another exemplary embodiment.
Figure 23:
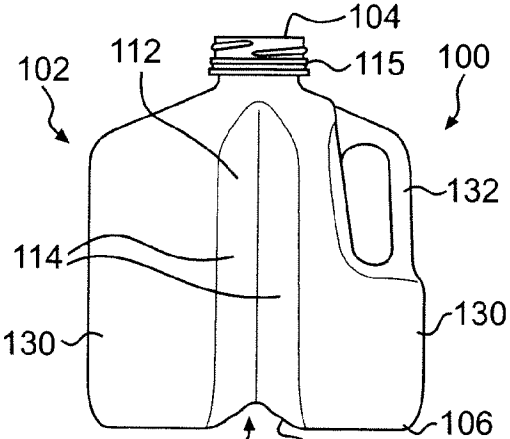
FIG. 23 is an elevation view of a collapsible container in accordance with a another exemplary embodiment.
Figure 25:
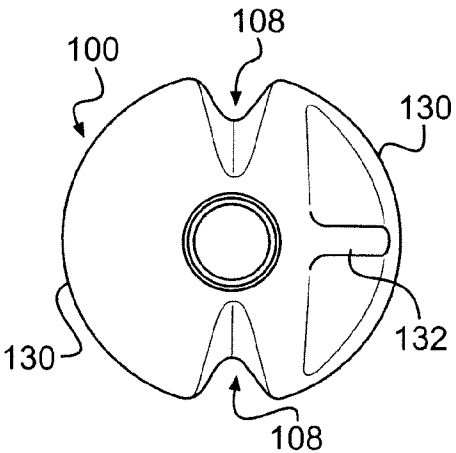
FIG. 25 is an elevation view of the collapsible container from a top perspective in accordance with another exemplary embodiment.

Referring now to FIGS. 19-22, shipping and storage space for the containers 10 may be further conserved via a nesting and stacking of multiple collapsed containers 10. Such nesting and stacking may be achieved (in a vertical stack 50) via complimentary cavities 52 defined by the bases 16 of the containers 10, and base legs 54 inherently created by cavities 52. As is shown in FIG. 19, the opening 18 (e.g., spout) of a first container 10*a* extends up into cavity 52*b* of a second container 10*b*, and base legs 54*b* extend around the nestable portion 12*a* and into the base volume 24*a* of a fully compressed container 10*a*. This nesting conserves shipping and storage volume, and aids in stabilization of the stacked containers.

Referring now to FIGS. 23-27, an exemplary embodiment of a collapsible container 100 is illustrated. This container 100 primarily differs from container 10 and container 500 due to its configuration for relatively horizontal collapsibility. The container 100 includes a container body 102 delimiting a fluid volume configured for holding a fluid, a container opening 104, and a container base 106. The container 100 is collapsible via collapsing zone 108, which, in the embodiment shown in FIGS. 23-27, includes a base segment 110 that laterally traverses the container base 106, and two vertical segments 112 that vertically traverse the container body 102. The vertical segments 112 are associated with each other via the base segment 110, are disposed at relatively opposing sides of the container body 102, and terminate at a neck/spout portion 115 that defines the container opening 104.

In one exemplary embodiment, such as that shown in FIGS. 23-27, the collapsing zone 108 is a groove extending into the fluid volume and including relatively opposing groove walls 114. The groove within collapsing zone 108 is collapsible via movement of opposing groove walls 114 towards each other. Of course, like in the vertically collapsing embodiment discussed above, the container 100 may be constructed such that material in the collapsing zone 108 is more easily collapsible or pliable relative to the rest of the container 100. In one embodiment, an extruded plastic (such as high density (hard) Polyethylene, low density (soft) Polyethylene, or a blend thereof) from which the entire container 100 is constructed is less densely constructed in the collapsing zone 108 than in the rest of the container 100. This may be achieved via permeation of air into the collapsing zone 108 during extrusion of the plastic, which in turn creates a more porous and less dense region and enhances pliability relative to the rest of the container 100.

In addition to or instead of being less densely constructed, the collapsing zone 108 may also be extruded and molded to include a lesser thickness than the rest of the container 100. Such a relative thinness in the container wall forming the collapsing zone 108 also serves to enhance pliability of the collapsing zone 108 relative to the rest of the container 100. Of course, the non-collapsing portion of the container 100 may be further extruded and molded to include support structure that hardens this area relative to the collapsing zone 108. Such support structure may include the rib structures (such as ribs 22, shown and described in FIGS. 1-10) and other features.

As an alternative to the grooves of collapsible zone 108 shown in FIGS. 23-26, it should be appreciated that the above discussed thinness/lesser density relative to the rest of the container 100 may allow for collapsibility of a zone that merely continues in and includes an arc and/or geometry that is consistent with the rest of the container 100. Still further, the zone may be constructed in this thinner/less dense manner, and include a consistent arc and/or geometry with creases or other weak points (as opposed to the grooves shown in the Figures) disposed at a relative center of the zone and/or at the junctions between the zones and the rest of the container 100.

Referring specifically now to actuation of collapsibility at the collapsing zone 108, it should be appreciated that this collapsing is best accomplished via an actuated force applied at areas 130 disposed approximately 90 degrees from the midpoint of each vertical segment 112. By applying force at these areas 130, which are also disposed to oppose each other, the opposing walls 114 of each groove 108 will move towards each other in a manner that collapses the groove 108 and the container 100 in general. As shown in the Figures, this force would be optimally applied at a container height disposed below an area of a container handle 132. This is because (in this embodiment) collapsing zone 108 traverses from the base 106 upward, but not all the way to the top (i.e., neck/spout 115) of the container 100. In fact, due to this non-traversal of collapsing zone 108 to the top of the container 100, overall collapse of the container 100 will be more dramatic towards the base 106 of the container 100 relative to its top.

Following collapse of collapsing zone 108, the container 100 may be sealed via seal or twist of cap 36 such as that shown in FIGS. 15-18. Due to vacuum conditions that may now be present in the collapsed container 100, the vacuum will hold the container 100 in a collapsed state. The container 100 may be collapsed and sealed for shipping and storage at any desirably collapsed level that is structurally allowable by movement of the opposing groove walls 114 towards each other. Collapsing and sealing the container 100 in this manner serves to reduce potential shipping and storage volume occupied by the container 100 by 33 to 67 percent. When the container 100 is needed for use, the cap 36 may be removed. The container 100, which may be constructed of plastic that includes material memory characteristics, may then expand to a non-collapsed configuration, when a vacuum is released or when product fills container 100.

It should be appreciated that though the Figures show only two opposing groove walls 114, additional opposing groove walls 114 are contemplated, and may extend from the base 106 vertically, as shown in FIGS. 23-26, or at an angle therefrom.

Figure 29:
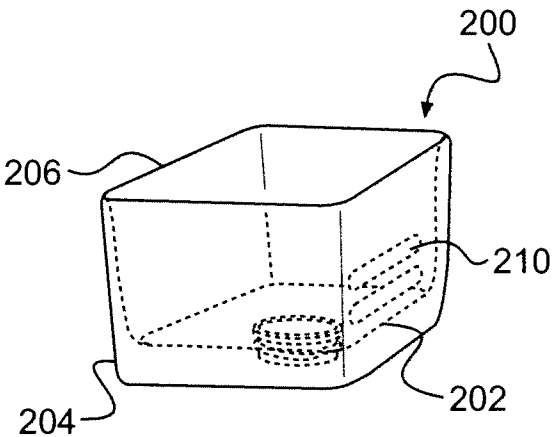
FIG. 29 is another elevation view of the collapsible container in accordance with another exemplary embodiment.
Figure 28:
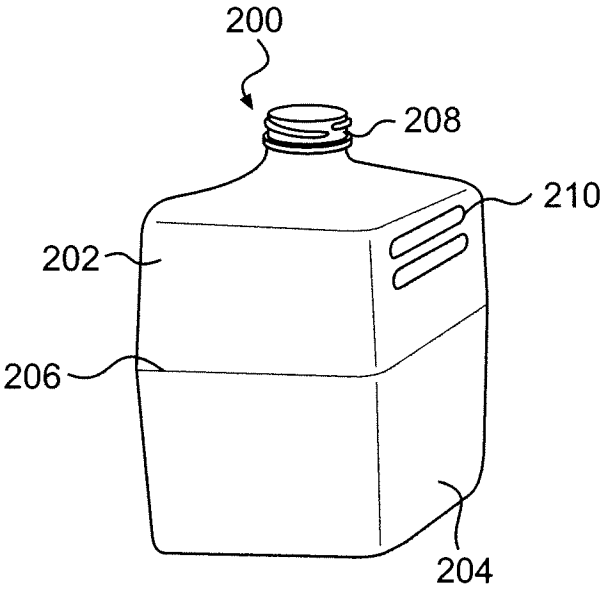
FIG. 28 is another elevation view of the collapsible container in accordance with another exemplary embodiment.

Referring now to FIGS. 28 and 29, an exemplary embodiment of a collapsible container 200 is illustrated. This container 200 includes a top portion 202 that may be collapsed into a base portion 204 via inversion. In this embodiment, an extruded plastic (such as high density (hard) Polyethylene, low density (soft) Polyethylene, or a blend thereof) from which the entire container 200 is constructed may be less densely constructed in the top portion 202 than the base portion 204. This may be achieved via permeation of air into the top portion 202 during extrusion of the plastic, which in turn creates a more porous and less dense region, enhancing pliability relative to the base portion 204.

In addition to or instead of being less densely constructed, the top portion 202 may also be extruded and molded to include a lesser thickness than the rest of the base portion 204.

Such a relative thinness in the container wall forming the collapsing top portion 202 also serves to enhance pliability of the top portion 202 relative to the base portion 204. Of course, the base portion 204 of the container 200 may be further extruded and molded to include support structure that hardens this area relative to the top portion 202. Such support structure may include the rib structures (such as rib structures 22, shown in FIGS. 1-10) and other features.

Actuation of the collapse/inversion of the top portion 202 may be accomplished via a downward force applied at an opening/spout 208 of container 200. Sealing and maintaining this collapsed form may be achieved via the same cap 36, as shown in FIGS. 25-28, and inherent vacuum conditions (created by collapse) discussed above. The container 200 may return to non-collapsed form via removal of the cap 36 and memory material, or from filling container 200 with product, such as a beverage. In addition, a concave handle 210 may be disposed in the top portion 202 to facilitate carrying the container 200 in its normal position, as shown in FIG. 28. Additionally, handle 210 may facilitate pulling the top portion 202 out of the base portion 204, when container 200 is in the collapsed position, as shown in FIG. 29.

Also as shown in FIGS. 28 and 29, top portion 202 is about the same height as bottom portion 204, and when container 200 is collapsed, as shown in FIG. 29, the collapse container has a total height of about ½ the total height of the container when in its normal position, as shown in FIG. 28. In this particular embodiment, a junction 206 integrally joins the top portion with the bottom portion, and is located at about the mid point of container 200. As shown in FIG. 29, junction 206 deforms about 180 degrees (or deform to form a U-shape) as measured from vertical when container transforms from its normal, full-open position (shown in FIG. 28), to the collapsed position shown in FIG. 29. In other words, as with folds 46 and 48 of the embodiment of FIGS. 1-10, junction 206 and top edge of top portion 202 are manufactured of a deformable material to allow container 200 to collapse, as shown in FIG. 29.

While the invention has been described with reference to exemplary or preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

The invention claimed is:

1. A collapsible container configured to transition from a collapsed position to an expanded position, said container comprising:

a bottom portion, said bottom portion having a height that is about ⅓ the total height of the container and wherein said bottom portion has a first diameter;

a top portion, said top portion having a second diameter, wherein said second diameter is less than said first diameter;

an intermediate portion, said intermediate portion connecting the bottom portion with top portion, characterized in that the intermediate portion comprises a first reinforcing ridge and a second reinforcing ridge;

wherein said first reinforcing ridge is positioned between the bottom end of the intermediate portion and the top end of the bottom portion, and is configured to elastically deform when said container transitions from the expanded position to the collapsed position, and said first reinforcing ridge having a material thickness that is greater than the material thickness of the intermediate portion and greater than the material thickness of the bottom portion; and wherein said second reinforcing ridge is positioned between the top end of the intermediate portion and the bottom end of the top portion, and is configured to elastically deform when said container transitions from the expanded position to the collapsed position, and said second reinforcing ridge having a material thickness that is greater than the material thickness of the intermediate portion and greater than the material thickness of the top portion;

wherein the top portion comprises top vertical ribs, said top vertical ribs arranged substantially perpendicular to the container base;

wherein the top vertical ribs axially strengthens the top portion relative to the intermediate portion, wherein the bottom portion comprises bottom vertical ribs, said bottom vertical ribs arranged substantially perpendicular to the container base;

wherein the bottom vertical ribs axially strengthens the bottom portion relative to the intermediate portion, and wherein a vacuum applied to the container causes the top portion to collapse within the bottom portion.

2. The container of claim 1, wherein at least one of the top vertical ribs or the bottom vertical ribs are spaced equally apart from one another around the circumference of the container.

3. The container of claim 1, wherein the top portion comprises a threaded opening, said threaded opening configured to engage with a threaded cap, wherein when said cap is engaged with the opening, an air-tight seal is created within the container.

4. The container of claim 1, wherein the top portion comprises a handle.

5. The container of claim 1, wherein the container is cylindrical about its vertical axis.

6. The container of claim 1, wherein the container is manufactured from a unitary piece of polyethylene.

7. The container of claim 1, wherein when the container is collapsed, the collapsed container is configured to nest with other similar collapsed containers.

* * * * *